United States Patent [19]

Watkins

[11] Patent Number: 4,954,819

[45] Date of Patent: Sep. 4, 1990

[54] COMPUTER GRAPHICS WINDOWING SYSTEM FOR THE DISPLAY OF MULTIPLE DYNAMIC IMAGES

[75] Inventor: Gary S. Watkins, Salt Lake City, Utah

[73] Assignee: Evans & Sutherland Computer Corp., Salt Lake City, Utah

[21] Appl. No.: 256,335

[22] Filed: Oct. 11, 1988

Related U.S. Application Data

[63] Continuation of Ser. No. 68,287, Jun. 29, 1987, abandoned, which is a continuation of Ser. No. 734,923, May 16, 1985, abandoned.

[51] Int. Cl.[5] ..... G09G 1/28

[52] U.S. Cl. ..... 340/721; 340/799

[58] Field of Search ..... 340/723, 724, 750, 721, 340/734, 747, 744, 799; 364/521

[56] References Cited

U.S. PATENT DOCUMENTS

| | | | |
|---|---|---|---|
| 4,663,617 | 5/1987 | Stockwell | 340/721 |
| 4,769,762 | 9/1988 | Tsujido | 340/721 |
| 4,772,881 | 9/1988 | Hannah | 340/703 |

*Primary Examiner*—Alvin E. Oberley

*Attorney, Agent, or Firm*—Nilsson, Robbins, Dalgarn, Berliner, Carson & Wurst

[57] ABSTRACT

For use in a computer graphics apparatus, a data management system drives a multiple-window dynamic display. The display is formed by areas, e.g. pixels, and windows are variously defined in a display by assigning window codes to groups of areas. Image data for each area provided from a picture system is selectively registered in an image frame buffer in accordance with the defined windows. Valid data binary signals, designating currently valid image data in the image frame buffer are registered in three valid data buffers. The image data for each area is provided for a display from the selectively registered signals in the image frame buffer under control of the window codes and the valid data binary signals. Techniques are thus available for rapidly swapping portions of the frame buffer and selectively clearing and loading the image frame buffer. Areas not specified by signals from the image frame buffer are treated as background and driven with an appropriate display.

13 Claims, 3 Drawing Sheets

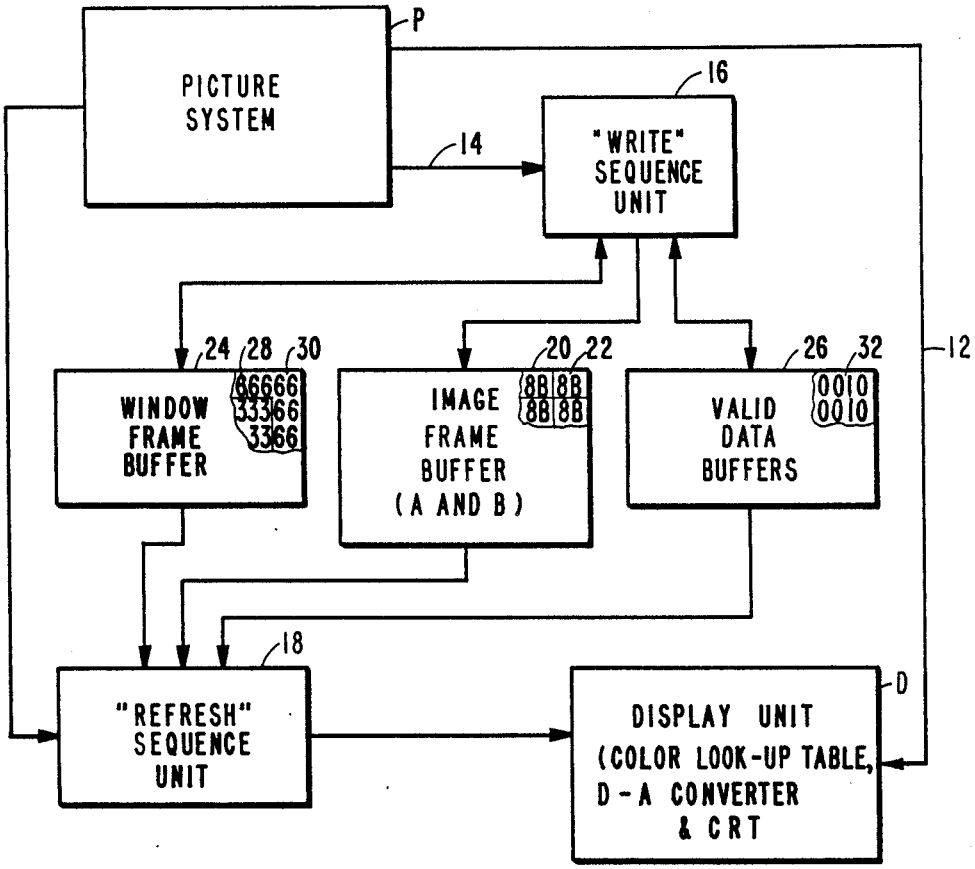
FIG. - 1
FIG. - 2
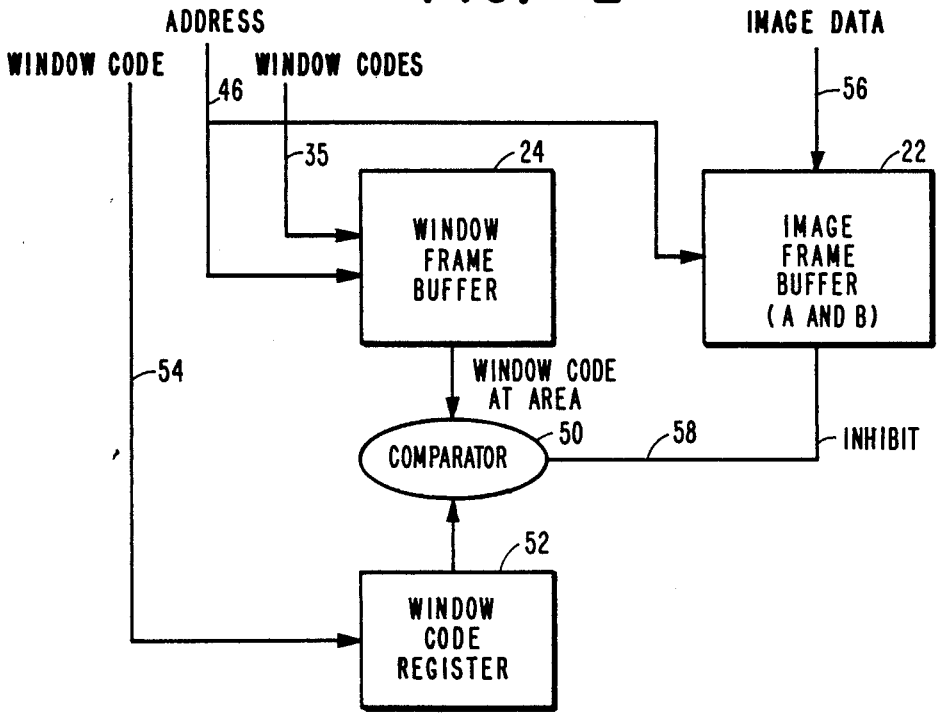

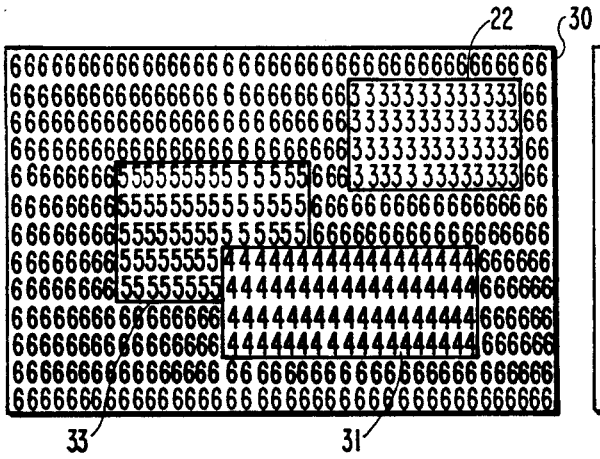
FIG. - 3A
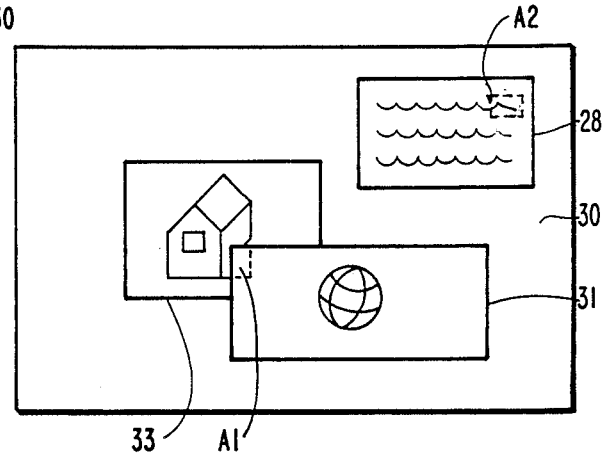
FIG. - 3B
| | SWAP | SWAP | SWAP | SWAP | |
|---|---|---|---|---|---|
| WRITE TO IMAGE BUFFER: | B | A | B | A | B |
| SET BITS IN VALID BUFFER: | V 3 | V 2 | V 1 | V 3 | V 2 |
| CLEAR BITS IN VALID BUFFER: | V 2 | V 1 | V 3 | V 2 | V 1 |
| DISPLAY FROM IMAGE BUFFER: | A | B | A | B | A |
| SELECT BACKGROUND DEPENDING ON VALID BUFFER: | V 1 | V 3 | V 2 | V 1 | V 3 |
TIME →
FIG. - 5

COMPUTER GRAPHICS WINDOWING SYSTEM FOR THE DISPLAY OF MULTIPLE DYNAMIC IMAGES

This is a Continuation of application Ser. No. 068,287, filed June 29, 1987 which is continuation of application Ser. No. 734,923, filed May 16, 1985 both abandoned.

BACKGROUND AND SUMMARY OF THE INVENTION

Computer graphics systems capable of providing dynamic displays (motion pictures) are well known in the prior art. To accomplish such displays effectively, with smoothly moving objects, it is necessary to frequently refresh the display with a new image. For example, every one-twentieth to one-sixtieth of a second a fresh display must be shown to avoid flicker and depict smooth movement. Consequently, memory must be effectively allocated and managed for the storage and delivery of picture data. Traditionally, such operations have involved compiling a display file as treated in the book, PRINCIPLES OF INTERACTIVE COMPUTER GRAPHICS, published 1979 by McGraw-Hill, Inc., by William M. Newman and Robert F. Sproull; specifically see Chapter 8.

In prior computer graphics systems, image data has been assembled for display using a so-called "double-buffered display frame buffer". Essentially, while a picture is being provided from one side of the frame buffer (as to drive a cathode ray tube display) the other side of the frame buffer is cleared of all previous data and rewritten with fresh data for the following picture. The roles of the frame buffer sides are reversed cyclically to provide image signals to the display apparatus in a rapid sequence. Such a technique has been effective in the past, particularly when the complete image (complete display of a screen) is treated as a single viewing window. However, in view of picture system developments, the technique has certain problems and limitations.

Picture systems have been developed that are capable of providing signals in rapid sequence that are representative of several different views concurrently. Accordingly, image data is available for several different dynamic images as on a split screen or windowed display. However, a problem arises in managing the data for refreshing such a multiple-window dynamic display. In that regard, consider the use of a traditional double-buffer frame buffer. Alternatively, the sides of the frame buffer receive data composed for display and deliver the data in ordered sequence. After supplying data, each side must be cleared to receive new data. Generally, the data for each elemental area, e.g. pixel, involves several binary bits. While an entire side of the buffer can be cleared in bulk very rapidly, selective clearing operations require considerable time. Consequently, selective clearing and writing operations, as for a multiple-window display, cannot be accommodated in a timely manner using traditional techniques.

Recapitulating to some extent, in dynamic frame buffers that only display the complete screen, it is relatively easy to swap and clear a buffer side quickly. However, for a windowed frame buffer system, where only a part of the screen is to be swapped and cleared, prior methods and apparatus are problematic.

In view of the above considerations, a need exists for an improved system for managing data preparatory to driving a multiple-window dynamic display. Specifically, a need exists for a system capable of performing the following operations: (1) the operation of selectively writing only to the window of interest in a display and not writing in other windows, even where one window partially overlays another; (2) the operation of selectively and rapidly clearing a window of interest without clearing the complete screen; (3) the operation of swapping the frame buffer corresponding only to a window of current interest; and (4) the selection of a given area within a given window whether data to be displayed on the screen comes from, (a) a default background color for the window, (b) one or the other side of the frame buffer, or (c) both buffer sides together (to yield more bits per pixel for nondynamic pictures). The operation of displaying so-called "pop-up menus" on the screen without destroying the contents of the picture in the frame buffers is also desirable.

In general, the dynamic display system of the present invention is capable of accomplishing the above operations in an expedient and economical manner. An image frame buffer stores image data which is entered and discharged in accordance with data registered in a window frame buffer and a plurality of valid data buffers. The window frame buffer registers window codes which define windows with respect to the contents of the image frame buffer. The valid data buffers hold indications of individual area data of current interest. Generally, the window frame buffer defines windows with respect to the image frame buffer and the valid data buffers define individual areas, e.g. pixels, of current interest with respect to the contents of the image frame buffer.

BRIEF DESCRIPTION OF THE DRAWINGS

In the drawings, which constitute a part of this specification, an exemplary embodiment of the invention is set forth as follows:

FIG. 1 is a block diagram of a system constructed in accordance with the present invention;

FIG. 2 is a block diagram of a component of the system as represented in FIG. 1;

FIG. 3*a, b* is a diagrammatic, unproportioned display representation illustrative of the operation of the system of FIG. 1;

FIG. 5 is a timing diagram indicative of the sequence of operation for the system of FIG. 1.

DESCRIPTION OF THE ILLUSTRATIVE EMBODIMENT

Figure 4:
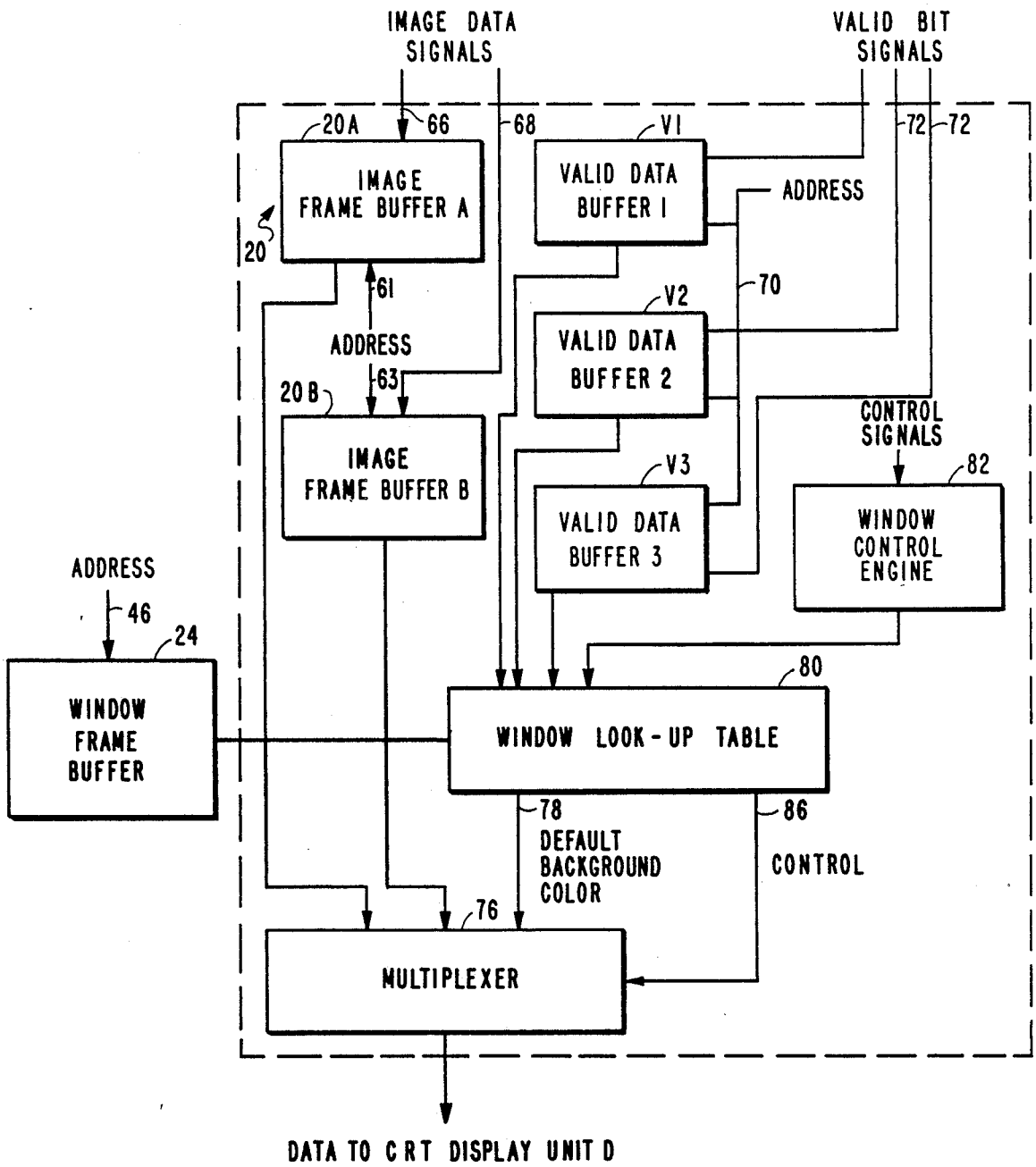
FIG. 4 is a block diagram of another component of the system of FIG. 1.

As indicated above, a detailed illustrative embodiment of the present invention is disclosed herein. However, image displays, data formats, component structures, and other elements in accordance with the present invention may be embodied in a wide variety of forms some of which may be quite different from those of the disclosed embodiment. Consequently, the specific structural and functional details disclosed herein are merely representative; yet in that regard, they are deemed to afford the best embodiment for purposes of disclosure and to provide a basis for the claims herein which define the scope of the present invention.

Referring initially to FIG. 1, a picture system P is represented (upper left) for providing elemental image signals to drive a display unit D (lower right). The picture system P provides synchronizing signals along with image signals indicative of elemental areas, e.g. pixels in a display composed according to a scan pattern. Managed and composed, such signals are capable of driving the display unit D to accomplish several dynamic images appearing in a plurality of distinct windows. In general, picture systems for developing picture signals are well known in the prior art and in that regard, the Picture System II is a form of such apparatus commercially available from Evans & Sutherland Computer Corporation. The apparatus is broadly described in the above-referenced book, PRINCIPLES OF INTERACTIVE COMPUTER GRAPHICS, see page 423. Description is also provided in a book, FUNDAMENTALS OF INTERACTIVE COMPUTER GRAPHICS, published 1984 by Addison-Wesley Publishing Company, Foley & Van Dam, see page 411 and following.

In the disclosed embodiment, the picture system P, provides picture signals that are managed to drive the display unit D. Accordingly, a display is composed as individual areas, e.g. pixels, treated in a raster scan pattern. Such areas are specified as with regard to color, light intensity and so on. For example, the display unit D may comprise a cathode ray tube apparatus. In accordance with the disclosed embodiment, signals from the picture system P are managed, e.q. compiled and arranged, for driving the display unit D in a raster pattern to accomplish multiple window displays. Accordingly, the composite display of the unit D may be variously fragmented into windows defined as by overlapping rectangles or other shapes. The number, size, and shape of windows may vary; and the display in each window may be either dynamic or static.

The picture system P is connected directly to the display unit D by a cable 12 carrying synchronizing signals related to deflection, timing, and related operations of the unit D. Image data signals representative of image areas or pixels are supplied from the picture system P through a channel 14 to a "write" sequence unit 16. Essentially, the "write" sequence unit 16 manages the movement of image signals into buffers from which such signals are selectively supplied through a "refresh" sequence unit 18. In that fashion, sequential image frames for the display are provided to the unit D.

In accordance herewith, elemental areas may be variously composed and defined. However, with respect to the illustrative embodiment, the areas are treated as single pixels. Accordingly, image data in the form of pixel signals are stored in an image frame buffer 20 to specify light and color for elemental areas of the display Essentially, the image frame buffer 20 may be considered to hold image data in an arrangement of pixel data units 22 similar to the arrangement of the display. Each elemental unit 22 of image data may comprise eight binary bits. Thus, the elemental storage units 22 are symbolically represented in FIG. 1 and for purposes of convenience may be considered to exist in a positional alignment coinciding to their associated pixels in a display.

Manipulation of data with respect to the image frame buffer 20 involves the content of other buffers, specifically a window frame buffer 24 and a set of valid data buffers 26. The window frame buffer 24 may be conveniently treated as a plane or arrangement of elements coinciding to the display area, e.g. pixel array of the display. In that regard, the window frame buffer 24 defines the current windows of a display in accordance with registered window codes. For example, a window 28 is defined by an array of window code "3" numerals. A window 30 for the display is indicated by an array of window code "6" numerals. Such window code numerals thus coincide to pixels. In that regard, note that the figures are not in scale.

The variable definition of windows in the display is treated in greater detail below; however, at present it should be understood that window codes (numerals) in the window frame buffer 24 specify the window format for the ultimate display by the unit D.

The image frame buffer 20 includes sides A and B. Two-sided frame buffers are well known and have been used in traditional systems as indicated above, wherein one side supplies image data to a display unit while the other side receives image data for the next frame of the dynamic display. After each sequence, the functions are swapped. In accordance herewith, control of the image frame buffer 20 is enhanced so that the frame sides A and B may be swapped in relation to windows of display.

Further selectivity in operating the image frame buffer is accomplished by the operation of the valid data buffers 26. In general when image data is being supplied from the image frame buffer 20, an associated one of the valid data buffers 26 designates data units 22 as valid or invalid. Only data units 22 that are designated as "valid" contain data to be used in a current display.

Essentially, as one aspect hereof, the valid data buffers 26 accommodate the operation of the image frame buffer 20 to stringent time demands by avoiding bulk clearance of image data. Accordingly, preparatory to writing in a side of the image frame buffer 20, it is not bulk cleared. Rather, fresh data (twenty-four bit pixel image data) is written only in the locations (units 22) to be used during the coming display. Such valid locations are designated by the presence of a validating binary signal, e.g. "one" digit, in an active one of the valid data buffers 26. Accordingly, an array 32 of binary digits is stored and may be considered to coincide with the array of units 22 in the image frame buffer 20. The presence of a "zero" bit in an associated location of a valid data buffer indicates that the coinciding element 22 (twenty-four bits) in the image frame buffer is to be ignored. Conversely, the presence of a "one" bit in the array 32 designates the coinciding data in a unit 22 as valid pixel data.

In view of the above introductory material, consider now the general operation of the system of FIG. 1. Initially, a window format is stored in the window frame buffer 24. An exemplary format enlarging on the windows 28 and 30 (FIG. 1) is illustrated in FIG. 3A. In that regard, the window codes are illustrated as registered in the window frame buffer 24 to define windows 28 and 30 along with additional windows 31 and 33. The representative display embodying the windows is illustrated in FIG. 3B. In that regard, note that the window code "3" defines a window 28 showing lines. The window code "4" designates a window 31 carrying a sphere and overlapping a window 33 defined by window codes "5" showing a shed. Note that the background window 30 is designated by window codes "6".

With the window codes from the picture system P stored in the window frame buffer 24 (FIG. 1), the system next proceeds to write image data pixel-by-pixel in the image frame buffer 20. Such data, in the exemplary form of twenty-four bit words, is stored in units 22 of the image frame buffer 20 as allocated for display in specific locations. Along with the entry of data in the image frame buffer 20, valid data bits are entered in one of the valid data buffers 26. Note that the valid data buffers are sequenced in such writing operations as disclosed in detail below. A "one" bit at a location in a valid data buffer to designate a specific element in the frame buffer 20 designates image pixel data that is to be displayed. Conversely, the presence of a "zero" bit in a location of the valid data buffer 26 indicates that the coinciding image data 22 in the image frame buffer 20 is not of present concern in the display. Accordingly, such a unit 22 in the image frame buffer 20 is ignored, not having been cleared or rewritten. As explained in detail below, the location of such areas (pixels) are displayed with background color. Accordingly, stick figures (FIG. 3B) can be represented by a relatively small amount of data for areas (pixels) commanding the use of a relatively small number of units 22 in the image frame buffer 20. Again, the background for such stick figures is provided by default under control of the valid data buffers 26 as explained in greater detail below.

The valid data buffers 26 allow the use of less than all of the storage units 22 in the image frame buffer 20 for any specific display. In that regard, the relationships between the individual valid data buffers 26 and the sides of the image frame buffer 20 changes during the course of a dynamic image display. As explained below, the disclosed embodiment incorporates three valid data buffers collectively represented by the block 32 in FIG. 1. While one valid data buffer is being set to reflect data written into one side of the image frame buffer 20, a second valid data buffer is being cleared and a third valid data buffer is discriminating between valid and invalid image data stored in the image frame buffer 20. Note that the valid data buffers 26 are considerably smaller than the image frame buffer 20, the former being restricted to an array of binary bits while the image frame buffer involves image data of twenty-four binary bits. The consideration is relevant with regard to the time for selectively setting bits in a valid buffer. The detailed sequencing of the system of FIG. 1 is treated in greater detail below.

To consider the operation of loading the image frame buffer 20 (FIG. 1), reference will now be had to FIG. 2 wherein the image frame buffer 20 is again represented along with the window frame buffer 24. FIG. 2 illustrates the structure and method for selectively entering image data in the buffer 20. Assume that the window frame buffer 24 (FIG. 2) has been loaded with window codes, for example as illustrated in FIG. 3A. Such codes are simply loaded into the buffer 24 from the picture system through a line 35. With respect to the illustrations of image data in FIG. 3: it is to be understood that a simplistic format is shown involving relatively few areas (pixels) of relatively large size. In an operating system, the display areas or pixels would be much smaller and far greater in number. However, the format has been simplified for purposes of explanation. Accordingly, consider now the operation of writing image data into the image frame buffer 20 as performed by the "write" sequence unit 16.

With the window frame buffer 24 (FIG. 2) loaded, an address is specified from the picture system P through a line 46 commanding both the image frame buffer 20 and the window frame buffer 24 to a specific location. Note that the line 46 is encompassed within the channel 14 (FIG. 1) so that the picture system P provides the individual addresses of pixels in a sequence. Of course, various arrangements may be employed; however, in one format the pixel-designating locations in the window frame buffer 24 are designated and considered in a raster scan pattern.

In a sequence as addressed, window codes from the window frame buffer 24 are supplied to a comparator 50 which also receives a window code from a window code register 52. Codes are supplied to the register 52 from the picture system P (FIG. 1) through a line 54. Thus, window codes for individual image areas are tested in the operation of loading the image frame buffer 20 with image data.

Generally, loading the image frame buffer 20 is accomplished by selecting a particular window code, e.g. window 33 designated by window code "5" (see FIG. 3A) and testing that code against areas (pixels) defined in the window frame buffer 24. Note that the area of overlap between the windows 31 and 33 (designated respectively by window codes "4" and "5") has been assigned the code "4" indicating that the areas will be displayed as illustrated in FIG. 3B.

To consider a sequence of operation, assume that a fresh view of the shed (window 33) is to be written into the image frame buffer 20 (FIG. 2). As indicated (FIG. 3A), the window 33 is represented by the window code "5". For each item of image data (twenty-four bits manifesting a pixel) that might be written into the image frame buffer 20, there is a test against the window code "5". If a match occurs, the data is written into the image frame buffer 20. If no match occurs (as in the case where the window 31 overlaps the window 33), then the data representative of an area in the window 33 is inhibited from being written in the image frame buffer 20.

Specifically, the window code, e.g. window code "5", is set in the window code register 52. Thereafter, address signals are supplied to the line 46 specifying areas for each location sequentially in the window frame buffer 24 and the image frame buffer 20. Consequently, as the window frame buffer 24 is addressed, window codes representative of specific areas are supplied to the comparator 50 to be tested against the window code contained in the register 52. As indicated, upon coincidence, the image data is loaded into the image frame buffer 20 at the address specified in the line 46. If the test does not indicate a comparison, then a signal generated by the comparator 50 is supplied through a line 58 to inhibit the acceptance of the image data in the buffer 20. Accordingly, the image frame buffer (side A or side B as currently involved) is loaded with image data coincident with a specific window as defined, e.g. window 33 (FIG. 3B) as defined by the window code "5" in FIG. 3A.

As explained above with reference to FIG. 1, sides A and B of the image frame buffer 20 are swapped in the functions of receiving written data and providing refresh data. In that regard, data is provided through the "refresh" sequence unit 18 (FIG. 1) to the display unit D. A component of the unit 18 is illustrated in FIG. 4 and will now be considered with regard to the manner in which data is supplied from the image frame buffer 20 to the display unit D.

Certain structural components as illustrated in FIG. 4 have been described above with reference to other figures. Specifically, the frame buffer window 24 is illustrated to receive addresses through a line 46. The image frame buffer 20 is represented by separate blocks indicative of each side, e.g. buffer side 20A and buffer side 20B. The sides A and B are shown connected to receive address signals in lines 61 and 63 and image signals through lines 66 and 68. Such signals are provided from the picture system P.

The valid data buffers (collectively represented by a single block 32 in FIG. 1) are represented as three separate buffers V1, V2, and V3 all connected to receive address signals independently through a cable 70 and loading signals through lines 72.

The image buffer sides 20A and 20B are connected to a multiplexer 76 for supplying control data to the display unit D. In that regard, the multiplexer 76 supplies digital data that may go to a color look-up table in the display unit before conversion by a D-A converter to an analog format for driving a cathode ray tube in the unit D. These structures and their operation are well known in the prior art.

The multiplexer 76 also is connected to receive background display data through a line 78 from a window look-up table 80. Essentially, the table 80 supplies the default background color for areas that are not supplied from image buffer sides 20A or 20B. The window look-up table 80 is controlled by a window control engine 82 connected to receive control signals from the picture system P (FIG. 1). The engine 82 has some computing capability to set up the storage of the window look-up table 80 preparatory to any specific display.

The window look-up table 80 controls the multiplexer 76 through a cable 86. Accordingly, the multiplexer 76 selectively passes image data for a pixel from the buffer side 20A, the buffer side 20B, or background from the window look-up table 80. The selection is controlled by the window look-up table 80 which receives control data from the window frame buffer 24, each of the valid data buffers V1, V2, and V3, and the window control engine 82. Thus, the window look-up table 80 is a key control element of the apparatus. The table 80 in conjunction with the window frame buffer 24 and the valid data buffers V1, V2, and V3 allow swapping between the buffer sides 20A and 20B and effective clearing of individual windows to be executed quickly accommodating the time demands of an effective, dynamic multiple window display To consider the operation of supplying data to the display unit D refer to the representation of FIG. 3. To perform the buffer swap function of window 33 (window code "5") from image buffer side 20B to side 20A, the window control engine 82 changes the contents of location code "5" in the window look-up table 80 to cause the multiplexer 76 to select data from the image buffer side 20A. Then, when the display unit screen is being refreshed, and when window 33 (window code "5") is being drawn, the window look-up table 80 causes the data from the buffer side 20A to be drawn.

Other windows on the screen as illustrated in FIG. 3, may independently prompt the multiplexer 76 to select either buffer side 20A or 20B as the source of image data. Accordingly, the swapping of individual window buffer sides can be done very quickly by the window control engine 82 writing only locations of the window look-up table that need to be swapped. Consider the operation with respect to the apparatus as illustrated in FIG. 4.

In the display of a frame, the window control engine sets up the look-up table 80 in accordance with received control signals. Note that the engine 82 may comprise a computer chip while the window look-up table 80 is essentially memory. The window control engine 82 also specifies one of the valid data buffers V1, V2, or V3, and one image frame buffer side, e.g. buffer side 20A or buffer side 20B for each area to be displayed and loads the window look-up table 80 to do the correct selection during the subsequent refresh operation. Consequently, as signals are provided in a scan pattern, e.g. raster, image data for individual areas is selectively provided either from the image buffer side 20A, the image buffer side 20B, or in the form of background data from the table 80. The window control engine 82 sets the look-up table 80 directly to control the selection of buffer side 20A or buffer side 20B. The selection between image frame buffer data and background data is determined by the contents of the window frame buffer 24, the currently associated valid data buffer V1, V2, or V3 and the contents of the window look-up table 80.

Assume, for example, that an area Al (FIG. 3B) is to be displayed. The area lies in window 31 and is specified by a window code "4". With the area addressed, the window frame buffer 24 (FIG. 4) provides the window code "4" to the window look-up table 80. Assume, for example, that in providing the display, the valid data buffer V1 is currently active. Consequently, the valid data buffer V1 is addressed to identify the same area Al of the display. Actually, the area A1 is simply background. Consequently, the valid data buffer V1 carries an invalid code, e.g. binary zero, indicating that the contents of the image frame buffer at area location A1 is to be ignored. A signal indicating that fact along with a signal indicating the window frame code "4" is supplied to the window look-up table 80. Consequently, the window look-up table responds with a signal to provide default background color in the line 78 for the display.

An alternative situation might involve the display of an area A2 (FIG. 3B) in the window 28 designated by the window code "3". The area A2 contains a line drawing. Consequently, data for the display will be designated as "valid" and provided from either the image frame buffer side 20A or the image frame buffer side 20B. Selection between the sides 20A and 20B is accomplished by the window look-up table 80 (previously loaded by the window control engine 82) and the multiplexer 76.

As suggested above, it is to be understood that areas as represented in FIG. 3 are grossly out of proportion; however, drawings are simply not susceptible to proportioned representations. In that regard, note that the area A2 while representing a single pixel or area of the display is illustrated to be substantially larger than the represented portion of the display in window 28.

In the interests of pursuing a clear explanation of the system, sequencing of the various operations has not been considered. However, it is to be understood that the various operations must be sequenced very quickly including the swapping functions and the clearing functions. Data in the image buffer 20 must be clearly defined before refreshing so that only current image data is displayed. Consequently, the three valid data buffers V1, V2, and V3 are specifically allocated with respect to each area of a window. In displaying a window, the window look-up table 80 is set to the appropriate valid data buffer, e.g. buffer V1, for the area. Thus, as explained above, based on the contents of the assigned valid data buffer, the window look-up table causes data to be passed from the image buffer or the default background signal is supplied by the window look-up table.

Before writing a new picture into a window, each valid data buffer must be cleared for all areas within a window. To accommodate clearing, one valid data buffer may be cleared during a display frame time That is, when writing a new picture into a window of the image frame buffer 20, the appropriate valid data buffer must be set for the area being written. The time sequences of writing to the image buffer, setting bits in the valid data buffers, clearing bits from the valid data buffers, and displaying data from the image buffers as well as selecting background data from a specific valid data buffer are set forth in FIG. 5. Conventional timing and sequencing control signals are provided to accomplish the sequences.

Consider the cycle of operation as illustrated in FIG. 5. The functions of the various units are plotted with time as the abscissa. Accordingly, at the beginning of the illustrated cycle, data is being written into image buffer side B. Concurrently, binary bits are being set in the valid data buffer V3. The contents of the valid data buffer V2 for this window is being cleared, and an image is being displayed from the buffer side A. At the same time, image background is being determined by addressing the valid data buffer V1. The operation continues until such time as a "swap" is commanded.

After a "swap", fresh image data is written into the image buffer side A, binary bits are set in the valid buffer V2 for the display, the appropriate contents of the buffer V1 are cleared, and the buffer V3 is active, e.g. to provide the selection of background data. Display is provided from the image buffer side B. Thus, as illustrated in FIG. 5, after each swap, the rotation occurs with the consequence that an orderly progression of functions is sequenced.

In view of the above, it may be seen that the system of the present invention accommodates certain specific desirable management operations with regard to the selective writing in a window of interest, clearing a window of interest, swapping a window of interest with respect to the image frame buffer, and selecting with regard to specific areas within a given window so as to provide data from either frame buffer or from a background source. It is important to appreciate that the valid data buffers V1, V2, and V3 are effective to validate selective data in the image frame buffer 20. Accordingly, in the exemplary embodiment a binary bit array designates valid and invalid image data in a twenty-four binary bit data array. For example, image data for each pixel might include eight bits for each of three colors. The window frame buffer 24 not only defines the windows but also specifies background color for areas that are not represented by current image data in the image buffer 20. That is, when an invalid area is indicated by the active valid data buffer, the window look-up table is set to provide the appropriate background color for display based on the window code received from the window frame buffer 24. These features are detailed herein with respect to the disclosed embodiment and in that regard it is to be appreciated that certain elements are key, as the function of swapping with respect to window displays, the use of valid data buffers to validate select area image data in the image frame buffer, and the use of a window frame buffer to designate areas of the display with window codes. However, the scope hereof is deemed properly determined in accordance with the claims as set forth below.

What is claimed is:

1. A dynamic window control system for use with a computer graphics apparatus, providing image data and control signals for a scan-pattern display, comprising:

an image frame buffer means for storing pixel area image data for said scan-pattern display;

a window frame buffer for defining a plurality of windows of said display;

a plurality of valid data buffers, each for storing a binary validity signal to designate select data pixels as stored in said image frame buffer; and means for supplying image data from said image frame buffer to said scan-pattern display in the sequence of said scan-pattern selectively under control of said window frame buffer and one of said valid data buffers.

2. A system according to claim 1 wherein said image frame buffer comprises a double frame buffer.

3. A system according to claim 1 wherein said window frame buffer comprises a memory for storing window codes designating individual pixels defining the windows of a composite display.

4. A system according to claim 1 wherein said means for supplying image data selectively supplies background data for areas for which data is not supplied from said image frame buffer means.

5. A system according to claim 1 further including means for writing data to load said image frame buffer comprising means for selecting image data for a specific window controlled by the contents of said window frame buffer.

6. A system according to claim 5 wherein said means for selecting comprises a comparator for testing window code signals from said window frame buffer and signals from a valid data buffer for a select window.

7. A system according to claim 1 wherein said means for supplying image data from said image frame buffer comprises means for alternatively supplying image data from a section of said image frame buffer means or signals representative of background under control of the contents of said window frame buffer, one of said valid data buffers and control signals.

8. A system according to claim 7 wherein said means for supplying image data includes a look-up table and a multiplexer.

9. A system according to claim 7 wherein said valid data buffers comprise three buffer planes.

10. A dynamic window control system for use with a computer graphics apparatus, providing image data and control signals for a scan-pattern display, comprising:

an image frame buffer means for storing pixel area image data for a display;

valid data buffer means for storing validity signals to designate individual data pixels as stored in said image frame buffer;

a window frame buffer including a memory for storing window codes designating individual pixels defining the windows of a composite display; and means for supplying image data from said image frame buffer to said scan-pattern display in the sequence of said scan-pattern under control of said valid data buffer means and said window frame buffer.

11. A system according to claim 10 wherein said valid data buffer means includes three binary storage buffers.

12. A system according to claim 11 wherein said three binary storage buffers of said valid data buffer means cyclically control the supply of image data to said scan pattern display.

13. A system according to claim 10 further including comparator means controlled by said window frame buffer for loading pixel area image data into said image frame buffer means.

* * * * *